US012331627B1

(12) United States Patent
Binstock

(10) Patent No.: US 12,331,627 B1
(45) Date of Patent: Jun. 17, 2025

(54) DESANDER FOR A DOWNHOLE ASSEMBLY

(71) Applicant: Jordan Binstock, South Heart, ND (US)

(72) Inventor: Jordan Binstock, South Heart, ND (US)

( * ) Notice: Subject to any disclaimer, the term of this patent is extended or adjusted under 35 U.S.C. 154(b) by 0 days.

(21) Appl. No.: 18/938,251

(22) Filed: Nov. 5, 2024

(51) Int. Cl.
*E21B 43/34* (2006.01)

(52) U.S. Cl.
CPC ..... *E21B 43/35* (2020.05)

(58) Field of Classification Search
CPC ..... E21B 43/35
See application file for complete search history.

(56) References Cited

U.S. PATENT DOCUMENTS 5,295,537 A * 3/1994 Trainer ..... E21B 43/35 166/105.3
10,605,064 B1 3/2020 Raglin
11,525,348 B2 * 12/2022 Xiao ..... E21B 43/38
11,708,746 B1 * 7/2023 Xiao ..... E21B 43/128 166/227
2010/0175869 A1 * 7/2010 Cobb ..... B04C 5/28 166/227
2016/0251951 A1 * 9/2016 Stachowiak ..... E21B 43/35 166/265
2017/0022797 A1 * 1/2017 Joshi ..... E21B 43/385
2018/0178151 A1 6/2018 Murray, Sr.
2018/0347335 A1 12/2018 Hemstock
2019/0309768 A1 * 10/2019 Todd ..... E21B 43/35
2019/0360314 A1 * 11/2019 Liu ..... E21B 43/35
2020/0282338 A1 9/2020 White
2021/0154601 A1 5/2021 Johnston
2022/0389805 A1 * 12/2022 Marshall ..... E21B 43/38
2023/0184077 A1 * 6/2023 Xiao ..... E21B 43/121 166/369
2024/0247576 A1 * 7/2024 Ellithorp ..... B01D 19/0057
2024/0344432 A1 * 10/2024 Snyder ..... E21B 43/38
2025/0101849 A1 * 3/2025 Steele ..... E21B 43/128

* cited by examiner

*Primary Examiner* — Shane Bomar
(74) *Attorney, Agent, or Firm* — Fargo Patent & Business Law; Thomas Kading; Joshua Krank

(57) ABSTRACT

A desander for a downhole assembly according to one disclosed non-limiting embodiment of the present disclosure includes a body that defines an axis; a support within the body; a sand downpipe within the body that extends from a sand downpipe inlet to a sand downpipe exit displaced from the sand downpipe inlet, the sand downpipe mounted to the support; and a solid-free intake to receive solid-free fluid from an upper body chamber.

14 Claims, 9 Drawing Sheets

DESANDER FOR A DOWNHOLE ASSEMBLY

CROSS REFERENCE TO RELATED APPLICATION[S]

None

BACKGROUND

The present disclosure relates to oil and gas wells, and more specifically to apparatus and methods for removing sand and other solid particles from multiphase fluid streams of a downhole assembly.

Production from wells in the oil and gas industry often contains sand. The sand could be part of the formation from which the hydrocarbon is being produced, introduced from hydraulic fracturing, fluid loss material from drilling mud or fracturing fluids, or from a phase change of produced hydrocarbons caused by changing conditions at the wellbore.

Oil wells are often equipped with a desander to remove sand from the fluid stream. The desander designs are often complicated and sand separation has primarily relied on helixes near the fluid intake to spin the solid-laden fluid and create separation of the heavier sand particles. The sand separation efficiency is thereby heavily dependent on fluid rates and velocity through the separation helix. Another issue may be that separation is so close to the fluid intake that a portion of the sand may still be drawn into the intake and, perhaps destructively, into the pump.

SUMMARY

A desander for a downhole assembly according to one disclosed non-limiting embodiment of the present disclosure includes a body that defines an axis; a support within the body; a sand downpipe within the body that extends from a sand downpipe inlet to a sand downpipe exit displaced from the sand downpipe inlet, the sand downpipe mounted to the support; and a solid-free intake to receive solid-free fluid from an upper body chamber.

A further embodiment of any of the foregoing embodiments of the present disclosure includes that the solid-free intake is connected to a downhole pump intake section.

A further embodiment of any of the foregoing embodiments of the present disclosure includes that the sand downpipe is parallel to the axis.

A further embodiment of any of the foregoing embodiments of the present disclosure includes a multiple of sand downpipes, each parallel to the axis.

A further embodiment of any of the foregoing embodiments of the present disclosure includes that the multiple of sand downpipes surround the solid-free intake within the support.

A further embodiment of any of the foregoing embodiments of the present disclosure includes that a sand collector below the sand downpipe exit with respect to the support.

A further embodiment of any of the foregoing embodiments of the present disclosure includes that the sand collector is frustoconical in shape.

A method of removing sand from a fluid stream for a downhole assembly, according to one disclosed non-limiting embodiment of the present disclosure includes receiving solid-laden fluid through one or more sand downpipes toward a bottom section discharge area separated by a vertical distance from a solid-free intake; and receiving solid-free fluid from an upper body chamber through the solid-free intake.

A further embodiment of any of the foregoing embodiments of the present disclosure includes that the sand downpipes are mounted in a support with the solid-free intake.

A further embodiment of any of the foregoing embodiments of the present disclosure includes that the heavier sand particles from the one or more sand downpipes drop to a sand collector at the bottom section of a desander.

A further embodiment of any of the foregoing embodiments of the present disclosure includes that the solid-free intake is along an axis and the one or more sand downpipes are parallel to the axis.

A further embodiment of any of the foregoing embodiments of the present disclosure includes that the solid-free intake is connected via a dip tube to a pump seating nipple or other pump intake section of the downhole assembly.

A further embodiment of any of the foregoing embodiments of the present disclosure includes receiving the solid-laden fluid through one or more sand downpipes, without helix separation.

A further embodiment of any of the foregoing embodiments of the present disclosure includes receiving the solid-laden fluid through one or more sand downpipes, without vortex separation.

A further embodiment of any of the foregoing embodiments of the present disclosure includes that the sand downpipes are mounted in a support with the solid-free intake within a body, a length and volume of a body related to a fluid production rate.

The foregoing features and elements may be combined in various combinations without exclusivity, unless expressly indicated otherwise. These features and elements as well as the operation thereof will become more apparent in light of the following description and the accompanying drawings. It should be appreciated that however the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
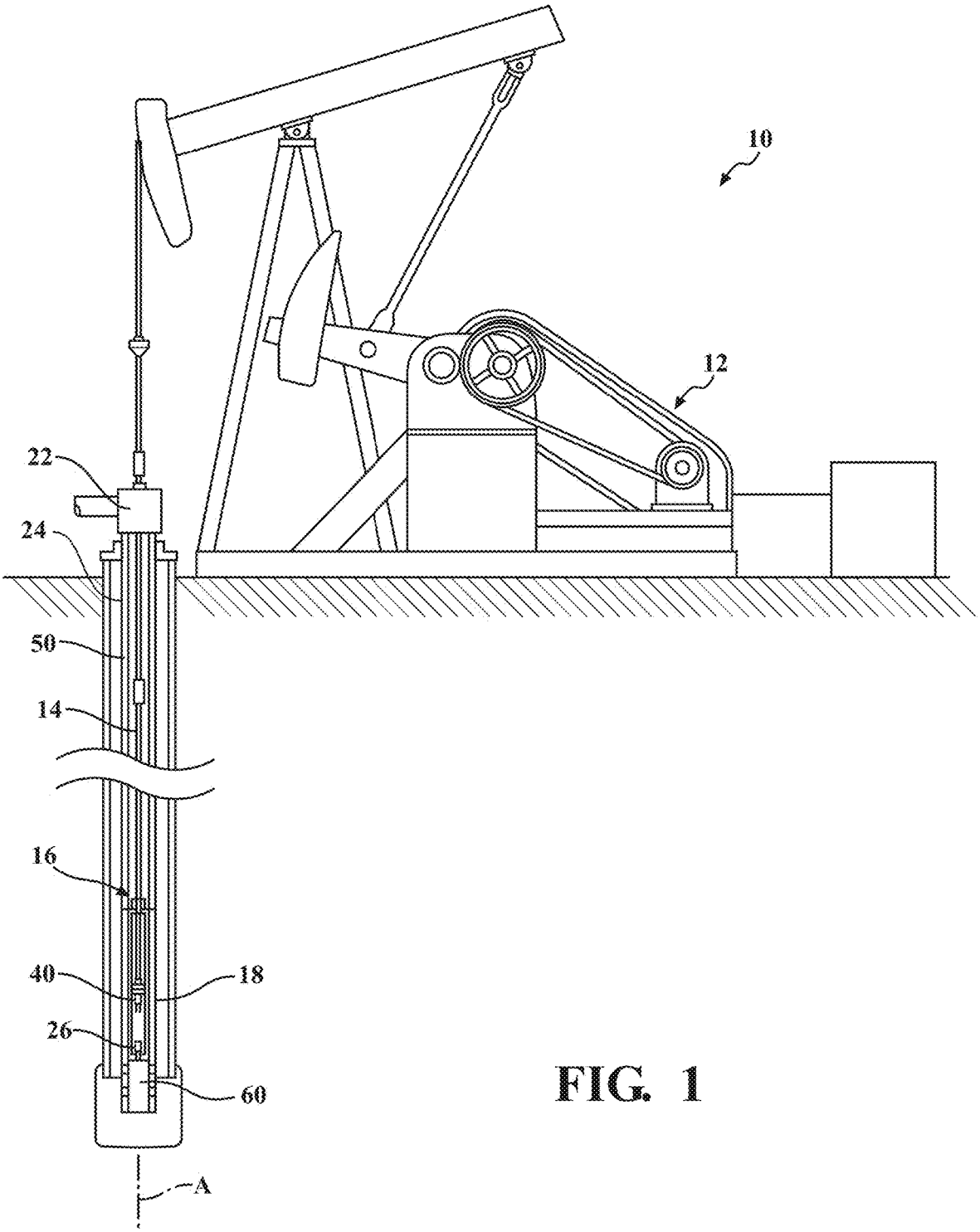
FIG. 1 is a schematic view of a downhole rod pump system according to one disclosed non-limiting embodiment.

FIG. 1 schematically illustrates a downhole rod pump system 10 that is used to produce fluid from a well. The downhole rod pump system 10 generally includes a surface unit 12 that is connected by a rod string 14 to a downhole pump 16. The surface unit 12 cycles the rod string 14 and thereby the downhole pump 16. The downhole pump 16 includes a pump barrel 18 that supports a standing valve assembly 26 located in a lower portion thereof. The standing valve assembly 26 typically includes a cage, a ball, and a seat, to allow the fluid to enter the downhole pump 16 from the well. The pump barrel 18 of the downhole pump 16 also supports a traveling valve assembly 40 above the standing valve assembly 26. The traveling valve assembly 40 allows fluid communication from the pump barrel 18 of the downhole pump 16 into a production tube 50 for communication to the surface and prevents fluid return from the production tube 50 into the pump barrel 18. The standing valve assembly 26 is attached to a seating nipple 60 to prevent the fluid from flowing back into the well bore when fluid pressure is greater within the downhole pump than the intake section below. The seating nipple 60 may be an integral part of the tubing string 24 or other pump intake section.

Figure 2A:
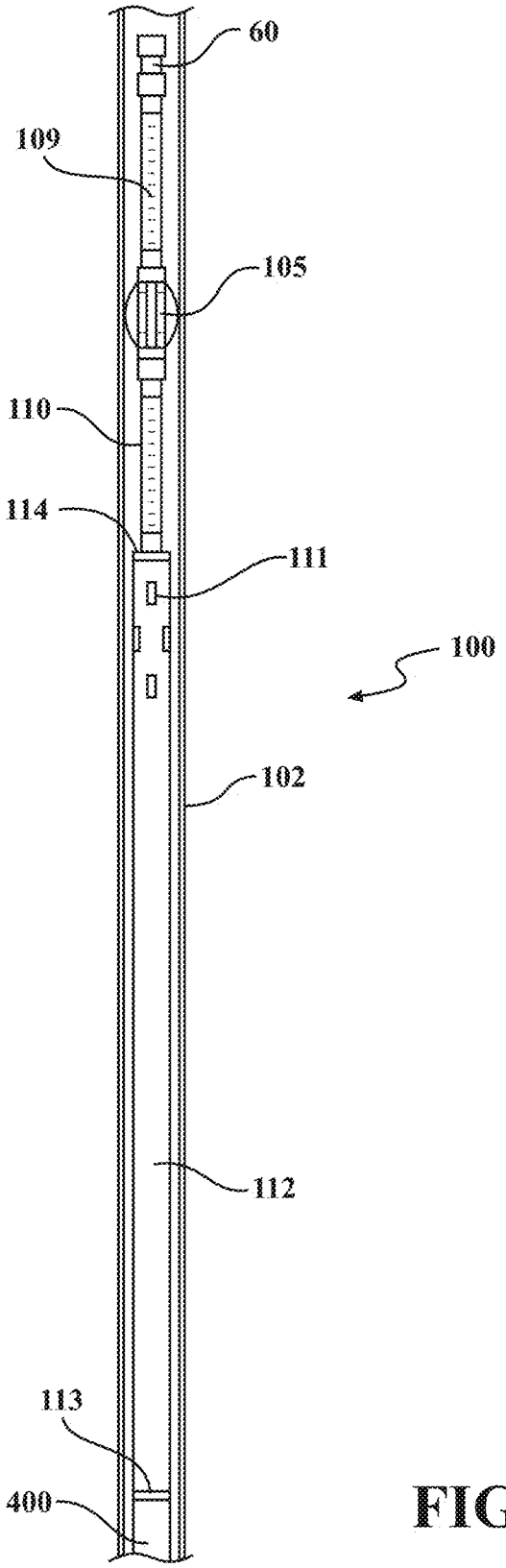
FIG. 2A is a schematic view of a downhole assembly according to one disclosed non-limiting embodiment.
Figure 2B:
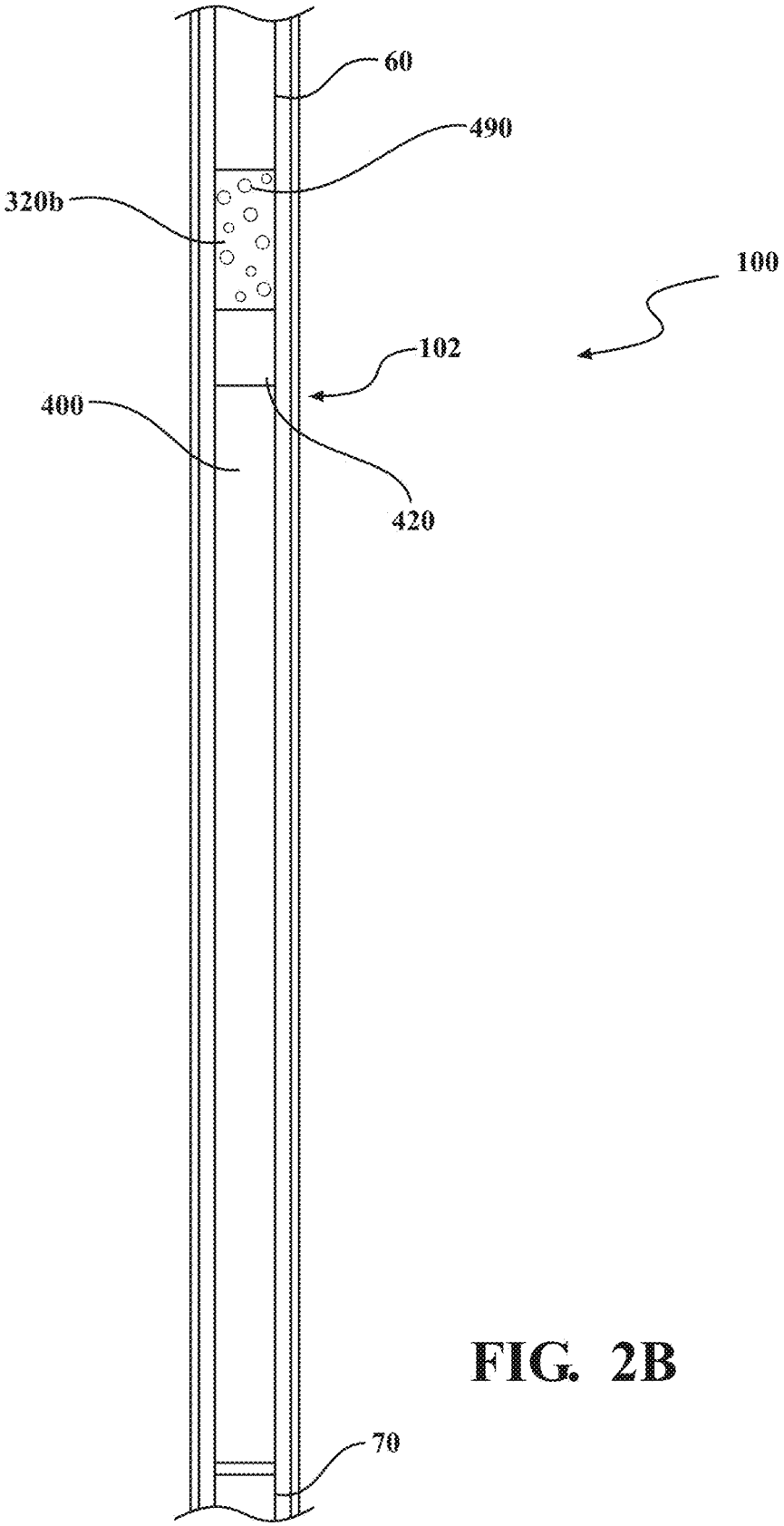
FIG. 2B is a schematic view of a downhole assembly according to another disclosed non-limiting embodiment.

With reference to FIG. 2, an exemplary downhole assembly 100 is shown within a well casing 102. For the purpose of this application, the downhole assembly 100 is understood to be the entire assembly connected to the bottom of the seating nipple 60 and above a tail pipe 70.

The downhole pump 16 is attached to the bottom of the rod string 14 and above the downhole assembly 100 by the pump seating nipple 60. The tubing string 24 extends from the top of the downhole pump seating nipple 60 to the surface wellhead 22. The downhole pump 16 is adapted to lift fluid from the downhole assembly 100 to the surface. Fluid is lifted to the surface by the pumping force exerted through the downhole pump 16 by the rod string 14 and flows upward through the tubing string 24. Alternatively, an electric submersible pump (ESP) may be utilized to exert a pumping force.

The wellbore 104 is the hole drilled into the ground in which the casing 102 is placed. An anchoring device 105 secures the downhole assembly 100 to the casing 102. In a vertical well application, the downhole assembly 100 is secured at a desired depth. In horizontal well applications, the wellbore 104 extends from the surface downward into the ground, and at a desired depth the wellbore 104 turns to a horizontal direction which is roughly parallel with the surface. The location where the wellbore 104 turns is considered the kickoff point. In a horizontal directional drilling application, the downhole assembly 100 is typically secured just above the kickoff point.

Figure 3:
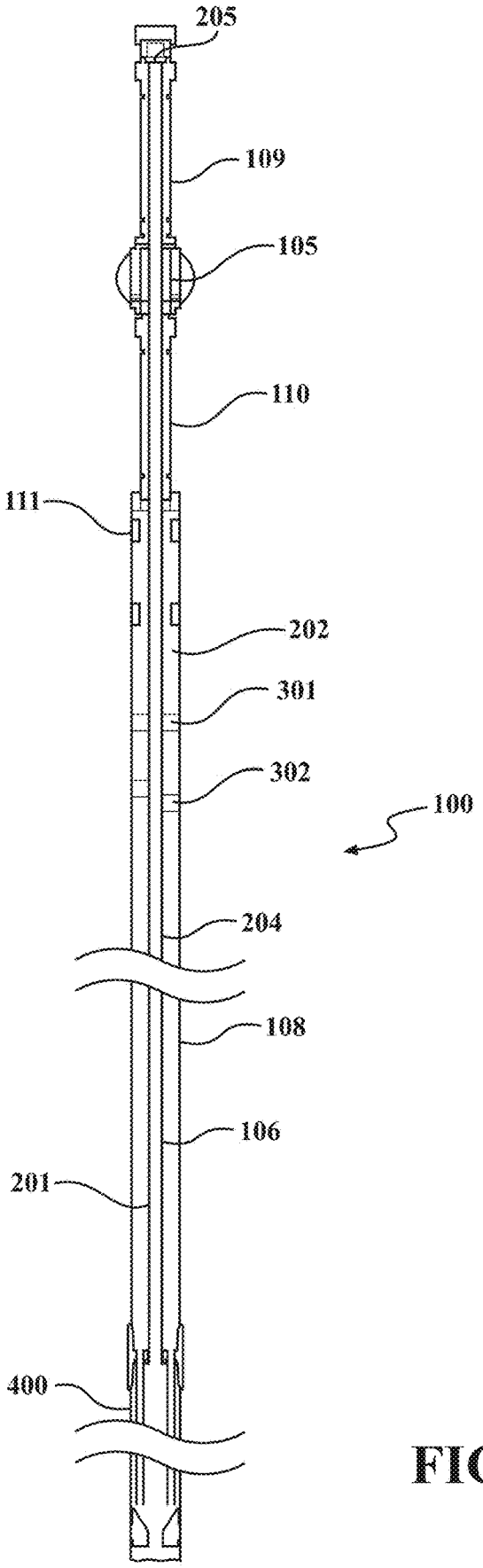
FIG. 3 is a cross-section of the downhole assembly of FIG. 2A illustrating a dip tube.
Figure 4A:
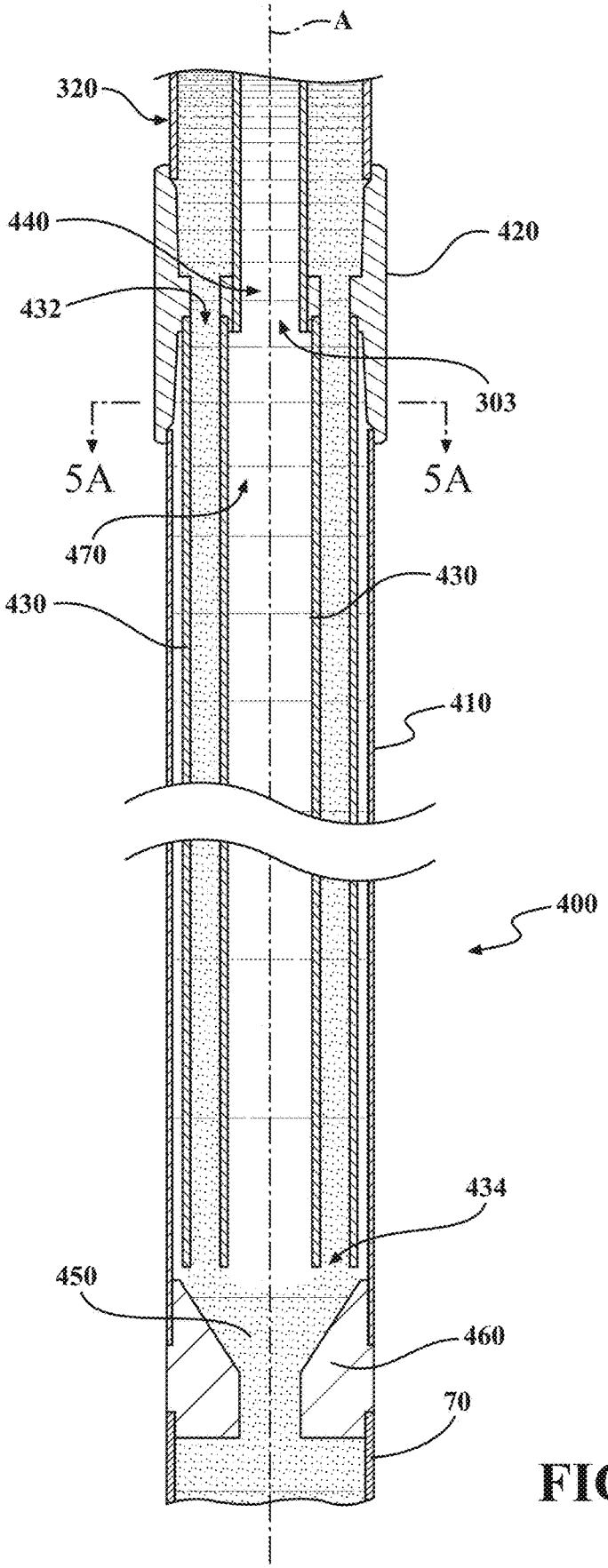
FIG. 4A is a longitudinal cross-section of a desander for the downhole assembly according to one disclosed non-limiting embodiment.
Figure 4B:
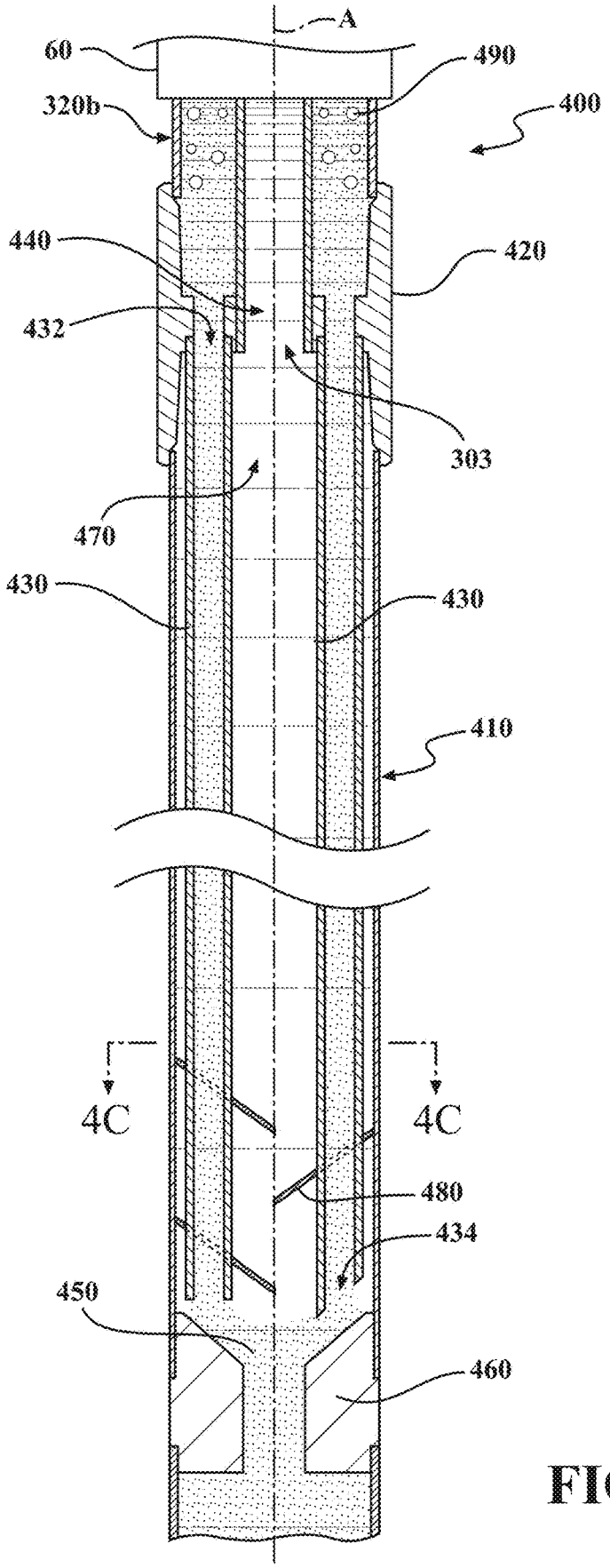
FIG. 4B is a longitudinal cross-section of a desander for the downhole assembly according to another disclosed non-limiting embodiment.

The downhole assembly 100, in one embodiment, may include the anchoring device 105, a dip tube 106 (FIG. 3), a slotted body 108, an upper perforated tube 109, a lower perforated tube 110, one or more helix structures (two shown 301, 302) which may be standard or reverse, and a desander 400 (FIG. 4A, 4B). Although shown in a specific separator assembly, the desander 400 can also be located under any other style gas separator or fluid intake section.

The slotted body 108 may have a hollow interior that can accommodate the passage of solids, gases, and fluids. The slotted body 108 includes one or more holes 111, an exterior surface 112, a bottom 113, a peak 114, and an interior surface 202 (FIG. 3). Oil with entrained gas located between the exterior surface 112 of the slotted body 108 and the casing 102 is pulled into the holes 111 by forces exerted from the downhole pump 16 and pressure from the reservoir below The dip tube 106 includes an upper connection 205, an exterior face 201, an inlet 303, and a pipe 204 between the upper connection 205 and the inlet 303. The inlet 303 of the dip tube 106 is adapted to be at a lower elevation relative to the holes 111. Typically, the inlet 303 of the dip tube 106 is located near the bottom 113 of the slotted body 108. The dip tube 106 is attached to the downhole pump seating nipple 60 such that a suction pressure from the downhole pump 16 is present at the inlet 303 of the dip tube 106. The dip tube 106 may alternatively be attached to a different type of downhole pump intake section. The inlet 303 of the dip tube 106 when the desander 400 is connected under a gas separator or a fluid intake section 320*b*, may extend into the desander 400.

The downhole pump 16 may be attached to the tubing string 24 at the pump seating nipple 60. The top of the downhole assembly 100 is attached to the bottom of a downhole pump seating nipple 60. For the purpose of this application, the downhole assembly 100 may be understood to be the entire assembly connected to the bottom of the downhole pump seating nipple 60.

Suction pressure from the downhole pump 16 at the inlet 303 of the dip tube 106 and pressure from the reservoir below causes wellbore fluid to flow through the holes 111, downward through the slotted body 108, thence into the inlet 303 of the dip tube 106. Oil sucked into the dip tube 106 flows upward through the dip tube 106, the downhole pump 16, then upward to the surface.

With reference to FIG. 4A, the desander 400 is connected to the seating nipple 60 via the dip tube 106. The desander 400 may be located between the gas separator/intake body and the tail pipe 70.

The desander 400 generally includes a body 410 that defines an axis A, a support 420, a sand downpipe 430 which extends from the support 420, and a solid-free intake 440 within the support 420. The support 420 may be connected to, and below, a gas separator body 320. Alternatively, the gas separator may be substituted with the fluid intake section 320*b*. FIG. 4B shows an embodiment of a desander 400 below the fluid intake section 320*b*, wherein an anchoring device 105 is not shown as utilized below the seating nipple 60, though in some embodiments it may. The anchoring device 105 may be located above or below the seating nipple 60. Connection to the gas separator body 320 allows for the use of a dip tube 106 of greater length. In one embodiment, the desander 400 provides for a fluid volume of, for example only, twice the pump stroke volume to provide a "quiet" time for the sand and other debris to settle out before fluid is drawn up towards the dip tube/pump intake through the solid-free intake 440. In other words, in this embodiment, every stroke of the downhole pump 16 may draw the approximately upper half of the fluid volume from within the desander 400.

The body 410 contains the support 420, the sand downpipe 430 and the solid-free intake 440. In one embodiment, the body 410 may be cylindrical and the support 420 is mounted thereto. In one embodiment, the length of the body 410 may be related to the fluid production rate. For example, desander 400 may be 4.5-5.0 inches in diameter and up to 20 feet in length.

Figure 5A:
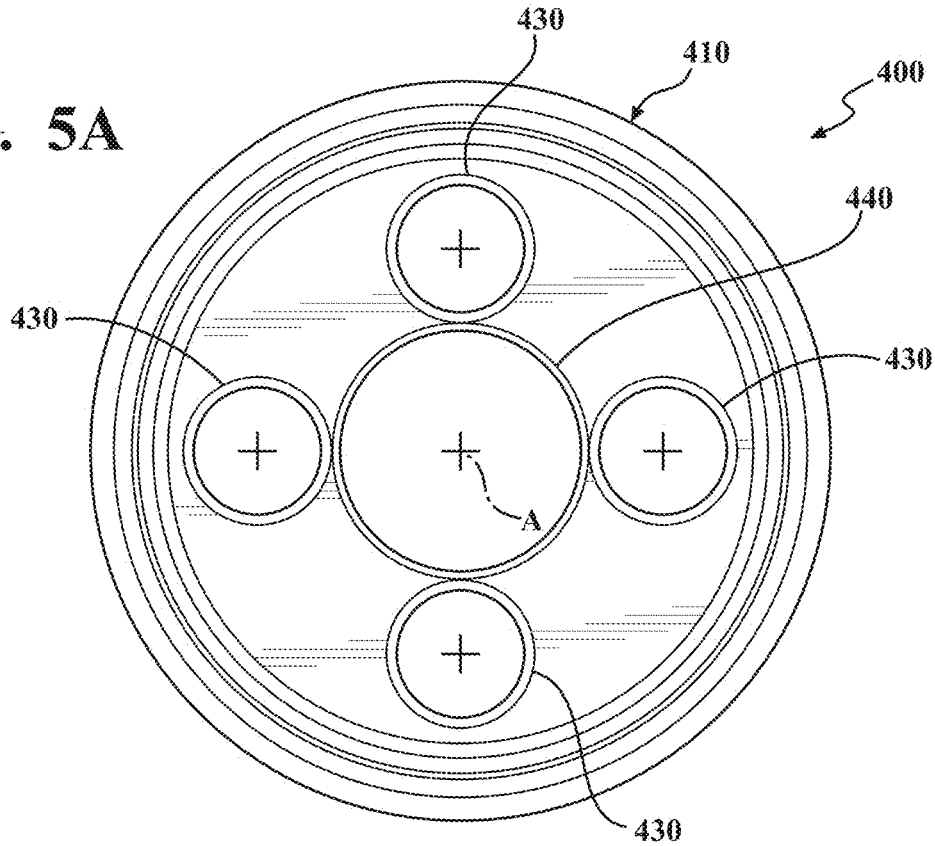
FIG. 5A is a lateral cross-section of a desander support.
Figure 5B:
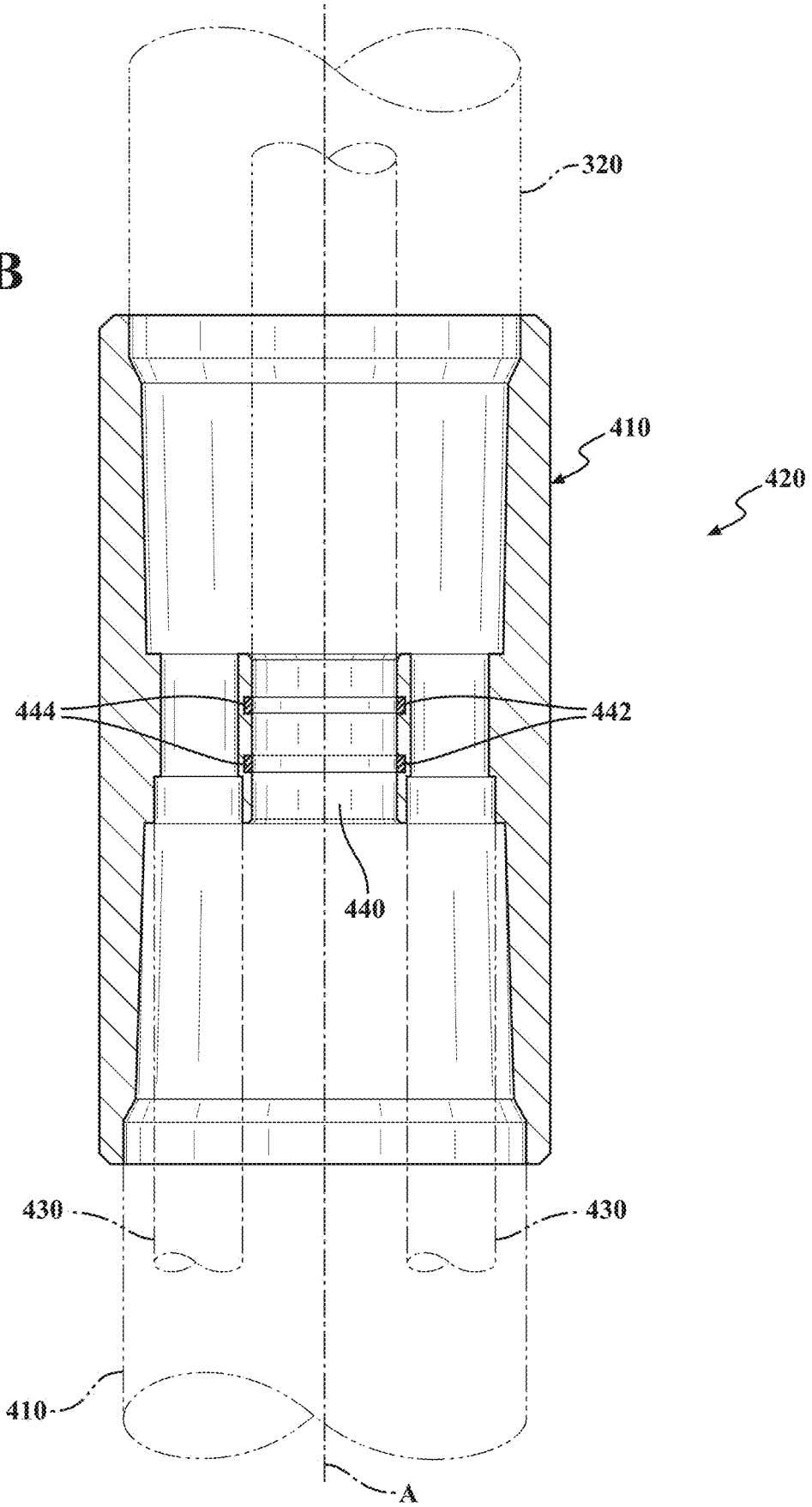
FIG. 5B is a longitudinal cross-section of the desander support.

One or more sand downpipes 430 may be mounted in the support 420 parallel or offset to the axis A. In one embodiment, each sand downpipe 430 may be a cylindrical tubular member. Each sand downpipe 430 defines a sand downpipe inlet 432 in the support 420 and extends to a sand downpipe exit 434 displaced from the sand downpipe inlet 432. Although four sand downpipes 430 (FIGS. 5A and 5B) are disclosed in the illustrated embodiment, any number may be provided. In embodiments, a multiple of sand downpipes 430 may surround the solid-free intake 440.

The solid-free intake 440 is located within the support 420 along the axis A to receive solid-free fluid from an upper body chamber 470. The solid-free intake 440 is located at the top section of the desander 400 and connected, via the dip tube 106, to the seating nipple 60 or other pump intake section of the bottom hole assembly. The solid-free intake 440 may include internal grooves 442 to receive O-rings 444 (FIG. 5B) to generate a true fluid seal around the dip tube 106. This allows the dip tube 106 from the above gas separator to be stabbed down into the solid-free intake 440 when the upper separator is attached to the tool. This facilitates a fluid seal while still being able to rotate the above gas separator assembly which forms the outside body threaded connections between the two separate tools. The dip tube 106 may alternatively seal to the solid-free intake with a very slight clearance fit which still allows for rotation but not the passage of solids.

Solid-laden fluid enters the desander 400 and is carried downward through the interior of the sand downpipes 430 to the bottom section discharge area 450 which is separated by a vertical distance from the solid-free intake 440. Gravity, downward flow velocity, and fluid retention time allow the heavier sand particles from the one or more sand downpipes 430 to continue toward the sand collector 460 at the bottom section discharge area 450 of the desander 400. In one embodiment, the sand collector 460 may be frustoconical in shape to facilitate channeling and retaining solids in the tail section.

With further reference to FIG. 4B apertures 490 in a fluid intake section 320*b* such as perforations, slots, etc., allow for fluid intake from the wellbore/reservoir directly into an area above the sand downpipe inlet. The fluid intake section 320*b* may be about 4 feet in length.

Figure 4C:
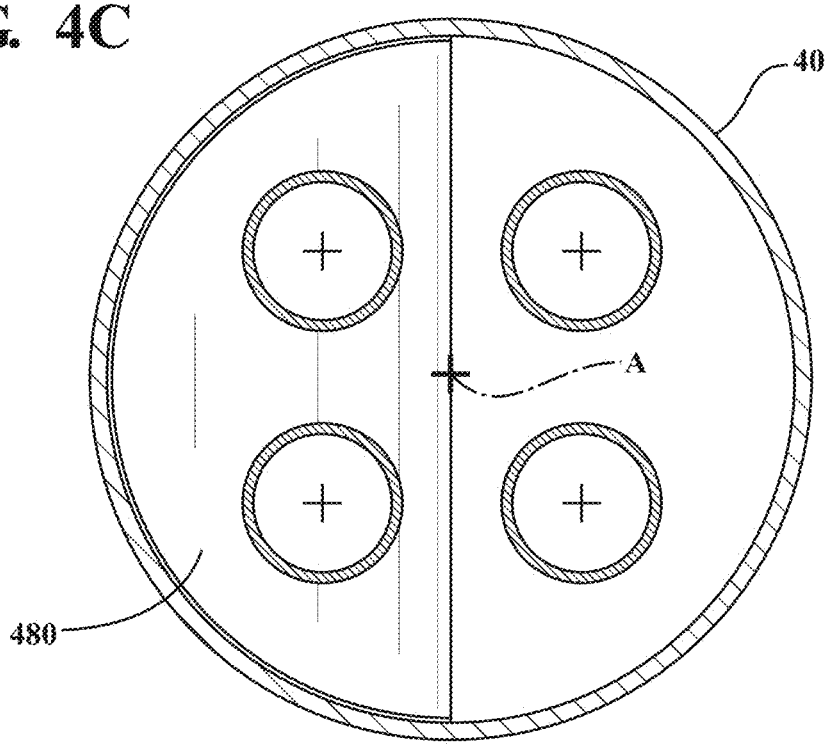
FIG. 4C is a lateral cross-section of the desander of FIG. 4B for the downhole assembly illustrating a fine particle diverter baffle.

One or more fine particle diverter baffles 480 (FIG. 4C) may additionally be arranged around the one or more sand downpipes 430 within the body 410 adjacent to the bottom section discharge area 450 to mitigate the tendency of very small particles of sand/solids to rise with fluid movement towards the solid-free intake 440. The fine particle diverter baffles 480 may be semi-circular features arranged in an alternating step like pattern. The fine particle diverter baffle 480 may be deflected at an angle downward (shown in FIG. 4B, 4C), level, or upward with respect to axis A. The downward arrangement is self-cleaning, however, the eddy currents generated by flat or upward options could potentially improve fine particle capture. The fine particles are thereby shifted laterally side to side and are trapped in the acute angle formed by the fine particle diverter baffles 480 as the very small particles of sand/solids rise with fluid movement towards the solid-free intake 440.

The desander 400 allows the solid-free intake 440 of the desander 400 to be isolated from the solid-laden fluid which exits the one or more sand downpipes 430 within the body 410 by utilizing multiple flow paths along a vertical height as well as the fluid flow to segregate the solid-free intake 440 within the support 420 and the bottom section discharge area 450 of the desander 400.

Figure 6:
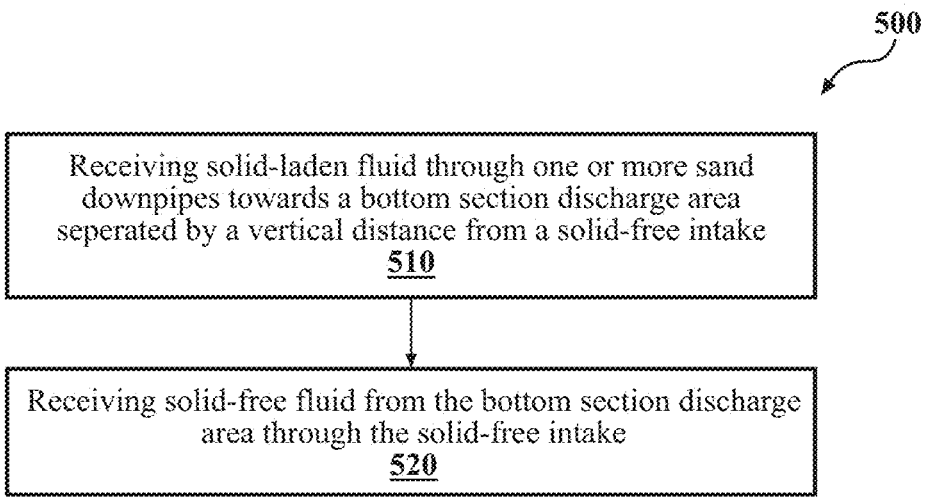
FIG. 6 is a flow chart of the method of operation of the desander.

With reference to FIG. 6 a method 500 for operating the desander 400 is schematically illustrated. The method 500 initially includes receiving solid-laden fluid through one or more sand downpipes toward a bottom section discharge area separated by a vertical distance from a solid-free intake (510). Gravity, downward flow velocity, and fluid retention time allow the heavier sand particles from the one or more sand downpipes 430 to drop to the sand collector 460 at the bottom section of the desander 400 such that the solid-free fluid is received (520) from an upper body chamber 470 through the solid-free intake 440. The solid-free fluid may then be transferred from the solid-free intake upward through the dip tube 106.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason, the appended claims should be studied to determine true scope and content.

What is claimed:

1. A desander for a downhole assembly comprising:
a body that defines an axis;
a support within the body;
a multiple of sand downpipes within the body that each extend from a sand downpipe inlet to a respective sand downpipe exit displaced from the sand downpipe inlet, the multiple of sand downpipes parallel to the axis; and
a solid-free intake to receive solid-free fluid from an upper body chamber.

2. The desander as recited in claim 1, wherein the solid-free intake is connected to a dip tube.

3. The desander as recited in claim 1, wherein the sand downpipe is parallel to the axis.

4. The desander as recited in claim 1, wherein the desander is connected to a gas separator.

5. The desander as recited in claim 1, wherein the multiple of sand downpipes surround the solid-free intake within the support.

6. The desander as recited in claim 1, further comprising a sand collector below the sand downpipe exit with respect to the support.

7. The desander as recited in claim 6, wherein the sand collector is frustoconical in shape.

8. A method of removing sand from a fluid stream for a downhole assembly, comprising:
receiving solid-laden fluid through a multiple of sand downpipes parallel to an axis along a solid-free intake toward a bottom section discharge area separated by a vertical distance from the solid-free intake; and
receiving solid-free fluid from an upper body chamber through the solid-free intake.

9. The method as recited in claim 8, wherein the multiple of sand downpipes are mounted in a support with the solid-free intake.

10. The method as recited in claim 8, wherein the heavier sand particles from the multiple of sand downpipes drop to a sand collector at the bottom section of a desander.

11. The method as recited in claim 8, wherein the solid-free intake is connected via a dip tube to a pump seating nipple or other pump intake section of the downhole assembly.

12. The method as recited in claim 8, wherein receiving the solid-laden fluid through the multiple of sand downpipes comprises receiving the solid-laden fluid without helix separation.

13. The method as recited in claim 8, wherein receiving the solid-laden fluid through the multiple of sand downpipes comprises receiving the solid-laden fluid without vortex separation.

14. The method as recited in claim 8, wherein the multiple of sand downpipes are mounted in a support with the solid-free intake within a body, a length and a volume of a body related to a fluid production rate.

* * * * *